US006648245B1

(12) United States Patent
Samwell et al.

(10) Patent No.: US 6,648,245 B1
(45) Date of Patent: Nov. 18, 2003

(54) SHOWER HEAD OPERATING MECHANISM

(75) Inventors: Christopher Samwell, Bushby (GB); Robert Bishop, Blaby (GB)

(73) Assignee: NewTeam Limited (GB)

( * ) Notice: Subject to any disclaimer, the term of this patent is extended or adjusted under 35 U.S.C. 154(b) by 0 days.

(21) Appl. No.: 09/856,344

(22) PCT Filed: Nov. 17, 1999

(86) PCT No.: PCT/GB99/03822

§ 371 (c)(1),
(2), (4) Date: Sep. 19, 2001

(87) PCT Pub. No.: WO00/30758

PCT Pub. Date: Jun. 2, 2000

(30) Foreign Application Priority Data

Nov. 21, 1998 (GB) ..... 9825448

(51) Int. Cl.[7] ..... B05B 7/02; B05B 9/01; B05B 9/08; B05B 3/04; B05B 3/16

(52) U.S. Cl. ..... 239/525; 239/530; 239/381; 239/456; 239/524

(58) Field of Search ..... 239/525, 530, 239/381, 456, 524, 380, 101, 588, 382, 383, 518, 590, 590.5, 520, 451, 457

(56) References Cited

U.S. PATENT DOCUMENTS 2,539,041 A 1/1951 Stott
2,734,770 A 2/1956 Kurata
3,762,648 A * 10/1973 Deines et al. ..... 239/381
4,141,502 A * 2/1979 Grohe ..... 239/381
4,579,284 A 4/1986 Arnold
5,090,624 A * 2/1992 Rogers ..... 239/381
5,356,077 A * 10/1994 Shames et al. ..... 239/383
5,833,138 A * 11/1998 Crane et al. ..... 239/106

* cited by examiner

*Primary Examiner*—Michael Mar
*Assistant Examiner*—Darren Gorman
(74) *Attorney, Agent, or Firm*—Young & Basile, P.C.

(57) ABSTRACT

The operating mechanism is shown consisting of a rotary actuating member or turbine wheel driven by water flow through the head, the wheel having a cam co-action with a plate fixed in the shower head. The resulting axial oscillation of the wheel is imparted to a closure or restricting stopper or plug relative to an outlet opening in an outlet plate of the head, the plug being carried by a shaft from the wheel. Variable or pulsating water emission is thus effected from the opening. A rear perforated feed plate directs water flow to the wheel which is shown resiliently loaded to maintain the cam co-action by a compression spring acting between the plate and wheel as in FIGS. 1 and 2. Positive two way cam operation of the wheel is shown in FIG. 3 by and between the feed plate and plate. The plug is screw adjustable on the shaft for variation of water emission and has a taper cooperation with the outlet opening.

8 Claims, 1 Drawing Sheet

SHOWER HEAD OPERATING MECHANISM

This invention has reference to shower heads usually in the form of hand sets and has for its object to provide shower head operating mechanism whereby a unique shower effect is provided and which may also be adjustable.

BACKGROUND OF THE INVENTION

By way of background prior art U.S. Pat. No. 4,579,284 (Arnold) discloses a spray head primarily for providing a pulsed emission of water in which a rotor within the head is rotated by water flow through the latter, the rotor also serving as a valve member and having a cam action cooperation with the inner end of a nozzle for oscillation relative to the nozzle in effecting pulsating water flow therethrough, the nozzle extending forwardly to provide an outlet at a front face plate of the head. The nozzle is axially adjustable in the head for varying pulsation of the water flow or for providing a continuous water spray from the head.

SUMMARY OF THE INVENTION

In contrast and according to this invention shower head operating mechanism wherein the shower head has a front outlet plate and contains at least one operating mechanism which includes a rotary member arranged for rotation within the head by water flow through the latter and also arranged for axial oscillation in said head in controlling water emission from the front outlet plate is characterized by the rotary member comprising a bladed turbine wheel for rotation by water flow through the head and having a cam co-action with at least one part fixed in the head for effecting axial oscillation of the turbine wheel, said turbine wheel having an axial shaft connection with a closure or water flow restricting member which cooperates with an outlet in the front plate whereby the closure or water flow restricting member is axially oscillated in said outlet for variable or pulsed water emission therefrom.

The closure or water flow restricting member may be axially adjustable relative to the turbine wheel shaft for obtaining variation in the form of the water emission from the shower head.

BRIEF DESCRIPTION OF THE DRAWINGS

A practical example of a shower handset containing operating mechanism according to the invention is shown in the accompanying drawings in which.

DESCRIPTION OF THE PREFERRED EMBODIMENT

Figure 1:
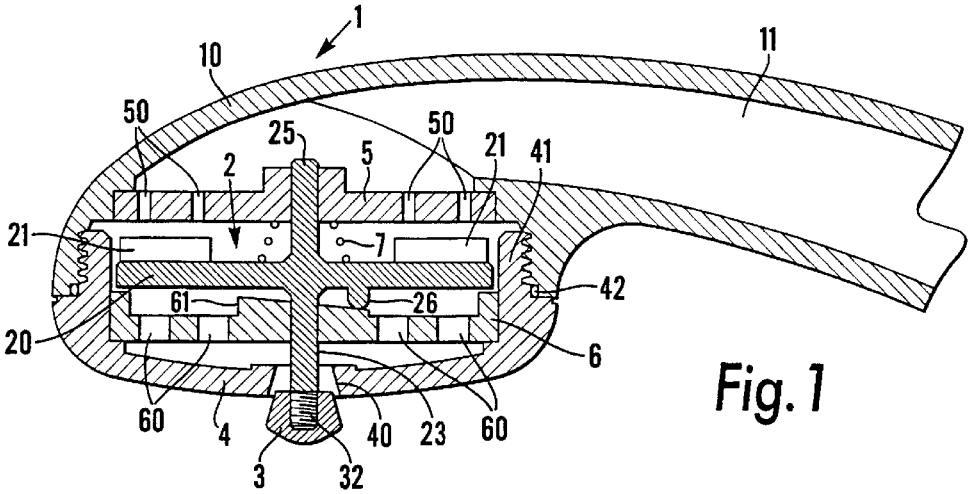
FIGS. 1 and 2 are axial plane cross sectional views of the shower hand set respectively showing an open position and a closed or restricting position of the operating mechanism.
Figure 2:
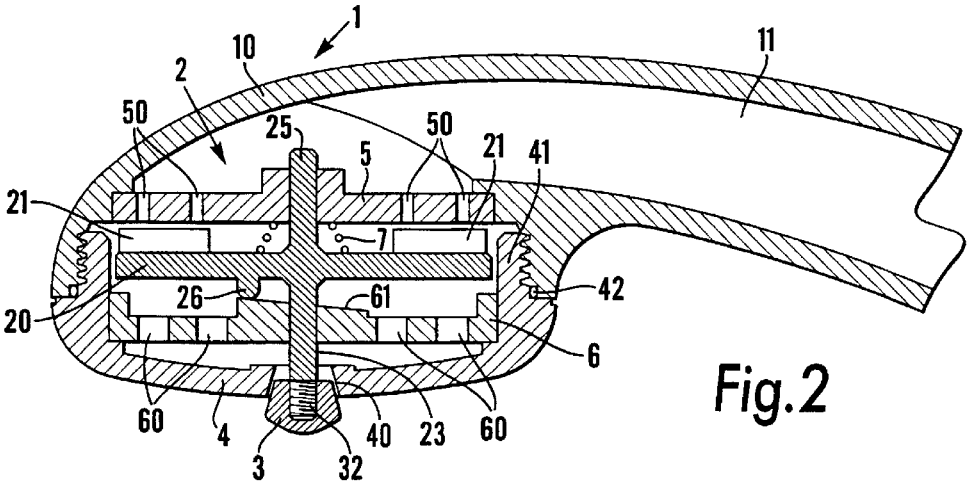

The head portion 10 of the handset 1 having a tubular handle 11 contains the operating mechanism 2 which is shown basically comprising a turbine wheel 20 having blades 21 and connected by a shaft 23 to a closure or restricting plug 3 received in an outlet opening 40 in the head spray plate 4. As usual the various parts of the handset 1 including the operating mechanism 2 are made of suitable plastic material (apart from any spring loading).

For assembly purposes the spray plate 4 is screw threaded by its side wall 41 into the head 10, a sealing O-ring being provided at 42. The turbine wheel 20 is concentrically located in the head 10 (and, as shown, within the spray plate 4) between an upper water feed plate 5 and a lower cam plate 6 through which the shaft 23 passes. An upper shaft 25 of the turbine wheel 20 is rotatably received in the feed plate 5 for suitable rotary support of the wheel 20.

Openings 50 in the feed plate 5 direct water flow within the head 1 against the upstanding blades 21 of the turbine wheel 20 to impart rotation to the latter, the blades 21 being preferably inclined from the radial direction or otherwise suitably arranged for obtaining an effective turbine action.

The underside of the turbine wheel 20 has a cam co-operation with the cam plate 6 and for this purpose is shown provided with a depending eccentric follower 26 which co-operates with a central cam formation 61 or boss on the cam plate 6 so that as the wheel 20 rotates it is subject to axial oscillation or reciprocation. Such oscillation is imparted to the shaft 23 and plug 3 for its opening and closing or restricting movement relative to the outlet opening 40.

Continuous contact of the follower 26 with the cam formation 61 is maintained by spring loading shown provided by a compression spring 7 acting between the feed plate 5 and the turbine wheel 20. The upper shaft 25 is of sufficient axial extent for oscillation in the feed plate 5 and so maintains upper support of the wheel 20.

A light spring 7 sufficient for the purpose should be employed so as to minimize frictional restriction of rotation of the wheel 20. An anti-friction washer may be interposed between the spring 7 and wheel 20.

In an alternative arrangement a compression spring may act on the underside of the wheel 20 from the plate 6 with an upstanding follower from the wheel 20 cooperating with central cam formation on the underside of the upper feed plate 5. However, this would entail a stronger spring to lift the wheel 20 and plug 3 against the water flow and which may result in increased friction between the spring and the wheel 20.

Figure 3:
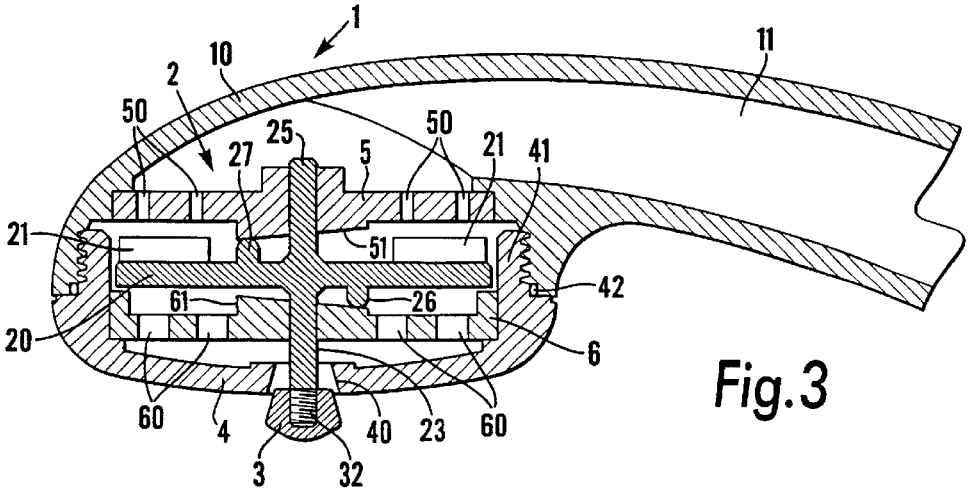
FIG. 3 is an axial plane cross section showing an alternative form of the operating mechanism.

The use of a spring can be dispensed with by providing a positive two way cam action. Thus as shown in FIG. 3 an upstanding eccentric follower 27 is also provided on the wheel 20 for cooperation with central cam formation 51 on the underside of the feed plate 5, i.e. in addition to the depending follower 26 and cam formation 61. As a result the wheel 20 and plug 3 are positively oscillated in both directions.

Other means of positive oscillation may be provided such as by radial pins extending from the wheel 20 and engaging cam slot formation in the side wall 41 of the spray plate 4 (or in the head 10) or vice versa.

The blades 21, shafts 23, 25 and the follower 26 or followers 26 and 27 are shown integral with the turbine wheel 20 e.g. as a plastic molding. Water flow through the head 10 would have a lubricating action in effecting easy operation of the working parts of the mechanism 2.

The cam plate 6 is also provided with openings 60 for passage of water from about the turbine wheel 20 to the outlet opening 40 in the spray plate 4. The outlet opening 40 and plug 3 are shown of corresponding outward taper form for suitable water emission.

In operation the rotating and oscillating turbine wheel 20 causes the plug 3 to be moved outwardly and inwardly relative to the outlet opening 40 so that a unique pulsating emission of water is obtained which may be of a fairly concentrated jet form. However, variation in the form of the water emission can be effected by axially adjusting the plug 3 on the shaft 23 by its screw mounting 32 on the latter. Thus by unscrewing the plug 3 outwardly a more divergent spray form of water emission can be provided. The rotation of the plug 3 relative to the outlet opening 40 may impart a swirling action to the water emission.

The plug 3 and outlet opening 40 may be of different shape, or corresponding shape, according to the nature of water emission requirements. Thus, for example, the plug 3 and outlet opening 40 may be of corresponding mushroom or part spherical shape.

More than one operating mechanism 2 with a corresponding outlet at 40 may be provided in one shower head e.g. by means of a suitable miniaturized form of each mechanism within the head. Each mechanism may operate in relation to a different type of outlet, and selector valve control of water flow to the mechanisms may be provided for their selective operation. It is to be understood that various other constructional and functional modifications may be made to the operating mechanism within the scope of the invention herein defined i.e. as incorporated in a shower head or supplied for use therein. The shower head may also include other selectable shower modes in any known or suitable manner.

What is claimed is:

1. Shower head operating mechanism wherein the shower head has a front outlet plate and contains at least one operating mechanism which includes a rotary member arranged for rotation within the head by water flow through the latter and also arranged for axial oscillation in said head in controlling water emission from the front outlet plate, the rotary member comprising a bladed turbine wheel for rotation by water flow through the head and having a cam co-action with at least one part fixed in the head for effecting axial oscillation of the turbine wheel, said turbine wheel having an axial shaft connection with a closure or water flow restricting member situated at the front exterior of the outlet plate for cooperation with an outlet opening in the front plate whereby the closure or water flow restricting member is axially oscillated in said outlet for variable or pulsed water emission therefrom.

2. Shower head operating mechanism according to claim 1 wherein the turbine wheel receives water flow directed to it through a first apertured feed plate fixed within the shower head and positioned upstream of the turbine wheel.

3. Shower head operating mechanism according to claim 1, wherein the closure or water flow restricting member is a plug, wherein the plug tapers inward toward the outlet opening for cooperation with a correspondingly formed tapered seating of the outlet opening.

4. Shower head operating mechanism according to claim 1 wherein the closure or water flow restricting member is axially adjustable on the axial shaft connection for obtaining variation in the form of the variable or pulsed water emission from the outlet opening.

5. Shower head operating mechanism according to claim 1 wherein the turbine wheel is axially spring urged for maintaining its cam co-action with the part fixed in the head.

6. Shower head operating mechanism according to claim 2 wherein the turbine wheel has cam co-action with the first fixed apertured feed plate and with a second apertured fixed plate located downstream of the turbine wheel.

7. Shower head operating mechanism according to claim 2 wherein the turbine wheel has a rearward axial shaft received in a rear part fixed in the head for rotary and oscillatory support of the turbine wheel.

8. Shower head operating mechanism according to claim 7 wherein the rearward axial shaft is received in the rear apertured feed plate as fixed in the head for said rotary and oscillatory support of the turbine wheel.

* * * * *